US007703578B2

(12) United States Patent
Kugiya et al.

(10) Patent No.: US 7,703,578 B2
(45) Date of Patent: Apr. 27, 2010

(54) ELEVATOR APPARATUS

(75) Inventors: Takuo Kugiya, Tokyo (JP); Ken-Ichi Okamoto, Tokyo (JP); Takashi Yumura, Tokyo (JP); Tatsuo Matsuoka, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 942 days.

(21) Appl. No.: 10/578,565

(22) PCT Filed: Apr. 28, 2004

(86) PCT No.: PCT/JP2004/006177

§ 371 (c)(1),
(2), (4) Date: May 5, 2006

(87) PCT Pub. No.: WO2005/105650

PCT Pub. Date: Nov. 10, 2005

(65) Prior Publication Data

US 2007/0170009 A1 Jul. 26, 2007

(51) Int. Cl.
*G08B 21/00* (2006.01)

(52) U.S. Cl. ..... 187/390; 187/391; 187/392; 187/393

(58) Field of Classification Search ..... 187/390–393
See application file for complete search history.

(56) References Cited

U.S. PATENT DOCUMENTS

| | | | | |
|---|---|---|---|---|
| 3,887,038 | A * | 6/1975 | Buschbom et al. | 187/259 |
| 6,123,176 | A * | 9/2000 | O'Donnell et al. | 187/393 |
| 6,227,334 | B1 * | 5/2001 | Yumura et al. | 187/359 |
| 2004/0074706 | A1 | 4/2004 | Ramseier et al. | |
| 2004/0118638 | A1 * | 6/2004 | Delaporte | 187/224 |
| 2004/0195047 | A1 * | 10/2004 | Wang | 187/266 |
| 2005/0133312 | A1 * | 6/2005 | Kaczmarek et al. | 187/266 |

FOREIGN PATENT DOCUMENTS

| | | | |
|---|---|---|---|
| JP | 20767/1978 | | 2/1978 |
| JP | 32381/1980 | | 3/1980 |
| JP | 57-126374 | | 8/1982 |
| JP | 4-292389 | | 10/1992 |
| JP | 6-345352 | | 12/1994 |
| JP | 8-301543 | | 11/1996 |
| JP | 8-324914 | | 12/1996 |
| JP | 9-278304 | | 10/1997 |
| JP | 10-25071 | | 1/1998 |
| JP | 10338434 | A * | 12/1998 |
| JP | 2001-192183 | | 7/2001 |
| JP | 2004142914 | A * | 5/2004 |
| WO | 03/053836 | | 7/2003 |

* cited by examiner

*Primary Examiner*—Walter Benson
*Assistant Examiner*—Kawing Chan
(74) *Attorney, Agent, or Firm*—Oblon, Spivak, McClelland, Maier & Neustadt, L.L.P.

(57) ABSTRACT

An elevator apparatus has a car suspended by a main rope through the intermediation of a shackle spring. The car is equipped with a displacement sensor for measuring the displacement amount of the main rope with respect to the car. The displacement sensor is electrically connected to an abnormality control device mounted on the car. The abnormality control device obtains the magnitude of the tension of the main rope based on information from the displacement sensor, and selectively outputs a braking command signal to one of the following devices: an operation control device, a brake device, and an emergency stop device, according to the magnitude of the tension of the main rope.

8 Claims, 15 Drawing Sheets

ELEVATOR APPARATUS

TECHNICAL FIELD

The present invention relates to an elevator apparatus having a structure in which a car is raised and lowered in a hoistway.

BACKGROUND ART

JP 2001-192183 A discloses a conventional elevator apparatus having a structure in which maintenance is performed when the expansion amount of a rope for suspending the car exceeds an allowable limit. In this conventional elevator apparatus, when the expansion amount of the rope exceeds the allowable limit, an alarm is given to the person in charge of the elevator.

However, if the expansion amount of the rope exceeds the allowable limit, the control of the elevator operation is continued as in the normal condition. As a result, even after the rope has become abnormal, the rope remains under a burden for a while. Further, it is only whether there is any abnormality in the rope or not that is detected, so it is rather difficult to properly cope with the abnormality in the rope.

DISCLOSURE OF THE INVENTION

The present invention has been made with a view toward solving the above-mentioned problems. It is an object of the present invention to provide an elevator apparatus making it possible to cope with any abnormality in the main rope for suspending the car according to the abnormality level.

According to the present invention, an elevator apparatus includes: a detecting portion which detects the magnitude of the tension of a main rope suspending a car; a plurality of braking devices which brake ascent/descent of the car by methods that are different from each other; and an abnormality control device which is capable of ascertaining the magnitude of the tension based on information from the detecting portion and which, when the magnitude of the tension becomes abnormal, selectively outputs a braking command signal to any one of the braking devices according to the magnitude of the tension.

BEST MODE FOR CARRYING OUT THE INVENTION

In the following, preferred embodiments of the present invention will be described with reference to the drawings.

Embodiment 1

Figure 1:
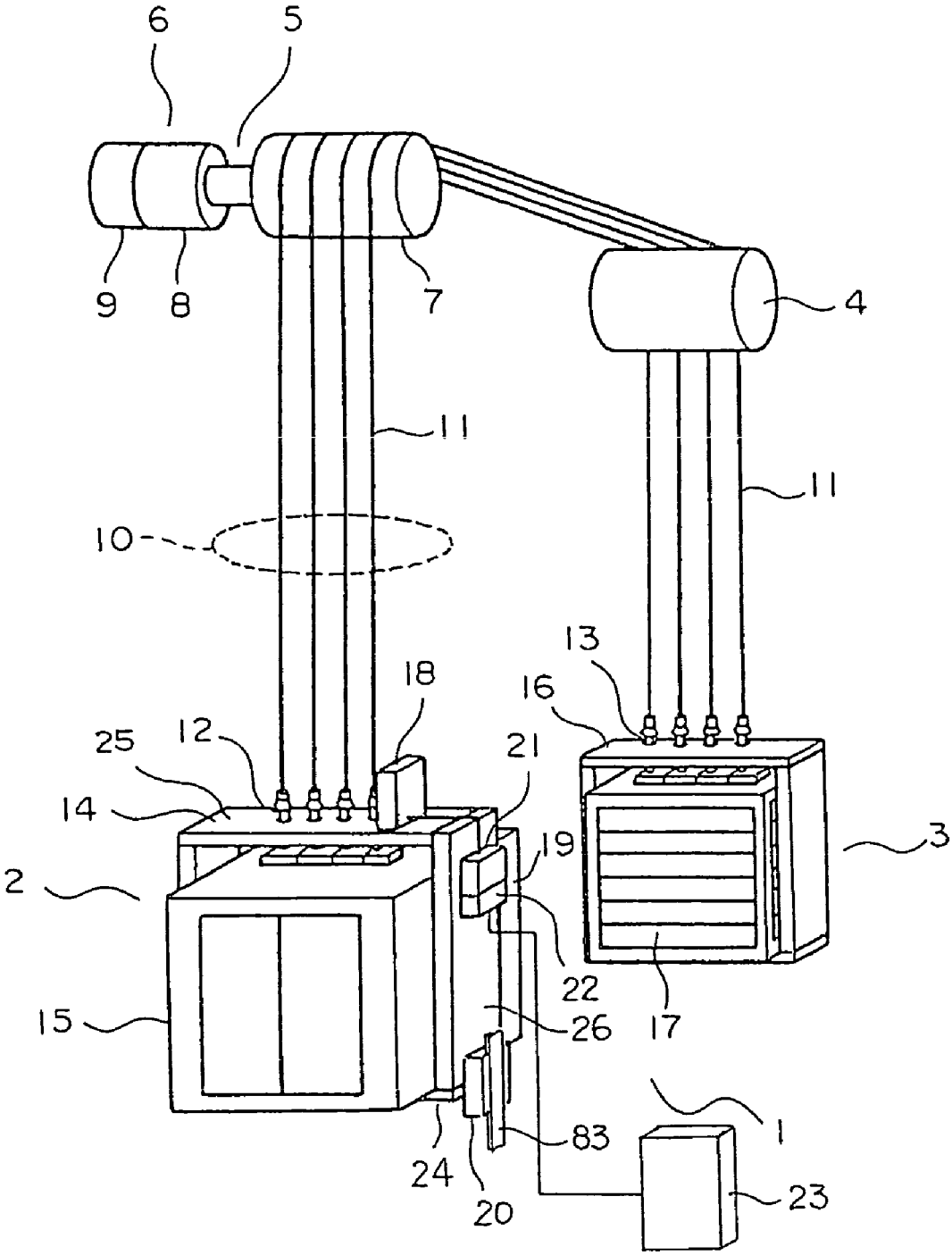
FIG. 1 is a perspective view of an elevator apparatus according to Embodiment 1 of the present invention.

FIG. 1 is a perspective view of an elevator apparatus according to Embodiment 1 of the present invention. In the drawing, provided in the upper end portion of a hoistway 1 are a deflection wheel 4 and a hoist 5, which constitutes a driving machine. A car 2 and a counterweight 3 are raised and lowered in the hoistway 1 by driving the hoist 5. Further, installed in the hoistway 1 are a pair of car guide rails 83 for guiding the car 2, and a pair of counterweight guide rails (not shown) for guiding the counterweight 3.

The hoist 5 has a hoist main body 6 and a drive sheave 7 that is rotated by driving the hoist main body 6. The hoist main body 6 has a motor 8 for rotating the drive sheave 7 and a brake device 9, which is a braking device for braking the rotation of the drive sheave 7. The brake device 9 has a brake wheel rotated integrally with the drive sheave 7, a brake shoe which is a braking member capable of coming into and out of contact with the brake wheel, a bias spring for biasing the brake shoe so as to press it against the brake wheel, and an electromagnetic magnet which separates, upon energization, the brake shoe from the brake wheel against the biasing of the bias spring (None of the above-mentioned components are shown in the drawing).

A plurality of main ropes 10 are wrapped around the drive sheave 7 and the deflection wheel 4. The car 2 and the counterweight 3 are suspended in the hoistway 1 by the main ropes 10.

Each main rope 10 has a rope main body 11, a first thimble rod 12 which is provided at one end of the rope main body 11 and which constitutes a connecting portion connected to the car 2, and a second thimble rod 13 which is provided at the other end of the rope main body 11 and which constitutes a connecting portion connected to the counterweight 3.

The car 2 has a car frame 14 to which the first thimble rods 12 are connected and a car main body 15 which is supported by the car frame 14. The car frame 14 has a lower frame 24, an upper frame 25 arranged above the lower frame 24, and a pair of vertical frames 26 provided between the lower frame 24 and the upper frame 25. The first thimble rods 12 are connected to the upper frame 25. The counterweight 3 has a weight frame 16 to the top portion of which the second thimble rods 13 are connected, and a weight main body 17 which is supported by the weight frame 16.

Mounted on the car 2 are a rope sensor 18 which is a detecting portion for detecting the magnitude of the tension of each main rope 10, an abnormality control device 19 which is electrically connected to the rope sensor 18, and a pair of emergency stop devices 20 which are arranged below the abnormality control device 19 and which constitute braking devices for braking the car 2. The rope sensor 18 is provided on the upper frame 25, and the abnormality control device 19 and the emergency stop devices 20 are provided on one of the vertical frames 26.

In the hoist way 1, there is provided an operation control device 23 for controlling the operation of the elevator. The brake device 9, the emergency stop devices 20, and the operation control device 23 are electrically connected to the abnormality control device 19.

The abnormality control device 19 has a processing portion (computer) 21 for processing information from the rope sensor 18, and an input/output portion (I/O port) 22 where the input of the information from the rope sensor 18 and the output of the processing results obtained by the processing portion 21, are effected.

The processing portion 21 stores rope abnormality degree judgment criteria for judging the degree of abnormality of each main rope 10. As the rope abnormality degree judgment criteria, three abnormality degree setting levels are set. That is, as the rope abnormality degree judgment criteria, there are set a first abnormality degree setting level which is of a value smaller than the magnitude of the tension of each main rope 10 during normal operation, a second abnormality degree setting level which is of a value smaller than the first abnormality degree setting level, and a third abnormality degree setting level which is of a value smaller than the second abnormality degree setting level.

It should be noted here that, as the main ropes 10 deteriorate, the expansion amount thereof increases. Further, as the expansion amount of the main ropes 10 increases, the magnitude of the tension of the main ropes 10 decreases. Consequently, the degree of abnormality of the main ropes 10 increases as the magnitude of the tension of the main ropes 10 decreases. That is, setting is made in the processing portion 21 such that the degree of abnormality of the main ropes 10 gradually increases in the following order: the first abnormality degree setting level, the second abnormality degree setting level, and the third abnormality degree setting level.

Further, based on information from the rope sensor 18, the processing portion 21 obtains the magnitude of the tension of each main rope 10. The processing portion 21 compares the magnitude of the tension obtained based on the information from the rope sensor 18 with the rope abnormality degree judgment criteria, whereby the degree of abnormality of each main rope 10 is judged. According to the degree of abnormality of each main rope 10, the abnormality control device 19 selectively outputs a braking command signal (trigger signal) to the operation control device 23, the brake device 9, and the emergency stop devices 20.

That is, a braking command signal is output from the abnormality control device 19 to the operation control device 23 when the magnitude of the tension of the main ropes 10 is not larger than the first abnormality degree setting level and larger than the second abnormality setting level, to the brake device 9 when the magnitude of the tension of the main ropes 10 is not larger than the second abnormality degree setting level and larger than the third abnormality setting level, and to each emergency stop device 20 when the magnitude of the tension of the main ropes 10 is not larger than the third abnormality degree setting level.

Upon the input of a braking command signal, the operation control device 23 controls the power supply to the motor 8 to brake the rotation of the drive sheave 7. Further, the operation control device 23 controls the power supply to the motor 8 such that the car 2 is settled at the nearest floor in a stable manner.

The brake device 9 is designed such that upon input of a braking command signal, the power supply to the electromagnetic magnet is stopped and that the brake shoe is pressed against the brake wheel by the biasing force of the bias spring. As a result, the rotation of the drive sheave 7 is braked.

Figure 2:
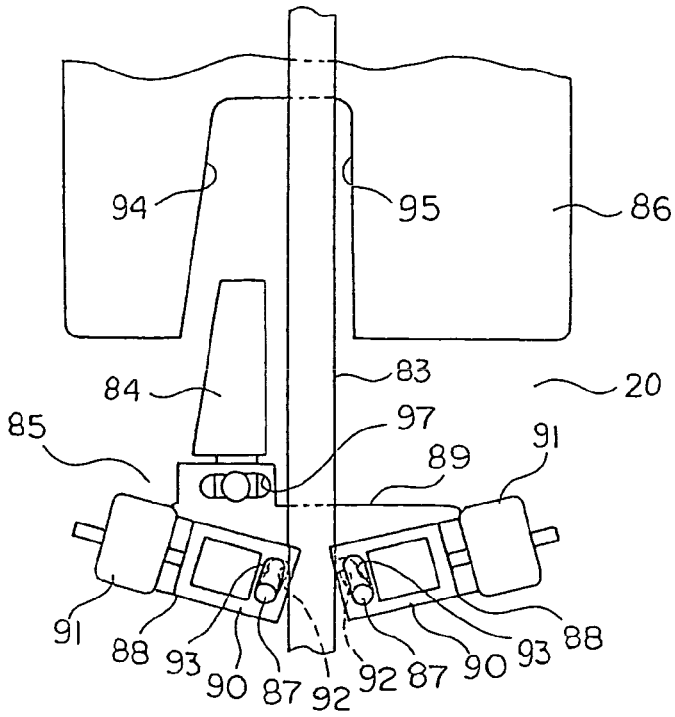
FIG. 2 is a front view of the emergency stop device of FIG. 1.
Figure 3:
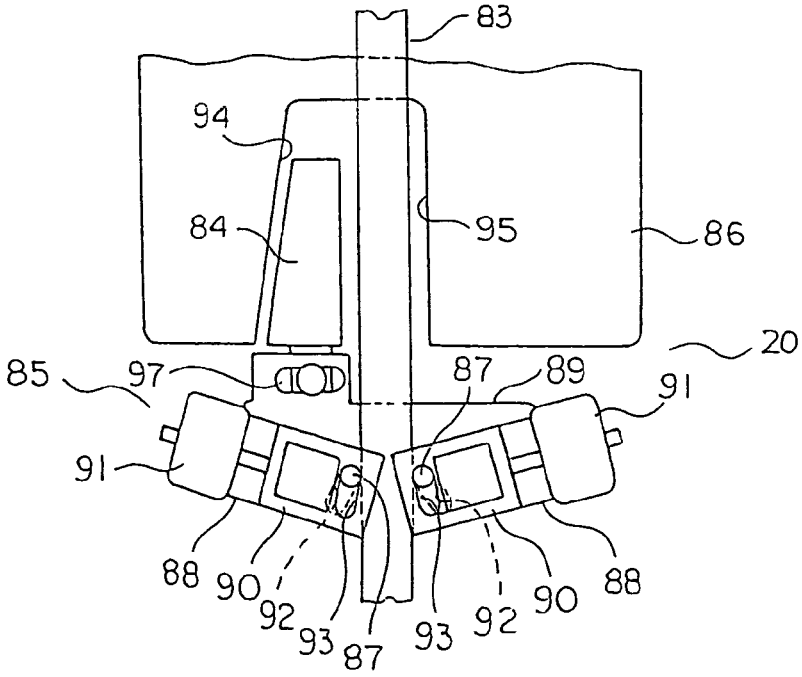
FIG. 3 is a front view of the emergency stop device of FIG. 2 during operation.

FIG. 2 is a front view of the emergency stop device 20 of FIG. 1, and FIG. 3 is a front view of the emergency stop device 20 of FIG. 2 during operation. In the drawings, the emergency stop device 20 has a wedge 84 which is a braking member capable of coming into and out of contact with a car guide rail 83, an actuator portion 85 connected to the lower portion of the wedge 84, and a guide portion 86 arranged above the wedge 84 and fixed to the car 2. The wedge 84 and the actuator portion 85 are provided so as to be vertically movable with respect to the guide portion 86. As it is displaced upwardly with respect to the guide portion 86, that is, as it is displaced toward the guide portion 86, the wedge 84 is guided by the guide portion 86 so as to come into contact with the car guide rail 83.

The actuator portion 85 has a cylindrical contact portion 87 capable of coming into and out of contact with the car guide rail 83, an operation mechanism 88 displacing the contact portion 87 so as to bring it into and out of contact with the car guide rail 83, and a support portion 89 supporting the contact portion 87 and the operation mechanism 88. The contact portion 87 is lighter than the wedge 84 so that it can be easily displaced by the operation mechanism 88. The operation mechanism 88 has a movable portion 90 capable of being reciprocatingly displaced between a contact position where the contact portion 87 is in contact with the car guide rail 83 and a separation position where the contact portion 87 is separated from the car guide rail 2, and a driving portion 91 for displacing the movable portion 90.

The support portion 89 and the movable portion 90 are respectively provided with a support guide hole 92 and a movable guide hole 93. The support guide hole 92 and the movable guide hole 93 are inclined with respect to the car guide rail 83 at angles that are different from each other. The contact portion 87 is slidably attached to the support guide hole 92 and the movable guide hole 93. As the movable portion 90 is reciprocatingly displaced, the contact portion 87 is caused to slide in the movable guide hole 93, and is displaced in the longitudinal direction of the support guide hole 92. Due to this arrangement, the contact portion 87 is brought into and out of contact with the car guide rail 83 at an appropriate angle. During the descent of the car 2, when the contact portion 87 comes into contact with the guide rail 83, the wedge 84 and the actuator portion 85 are braked, and are displaced toward the guide portion 86.

Above the support portion 89, there is provided a horizontal guide hole 97 extending in the horizontal direction. The wedge 84 is slidably attached to the horizontal guide hole 97.

That is, the wedge 84 is capable of being reciprocatingly displaced in the horizontal direction with respect to the support portion 89.

The guide portion 86 has an inclined surface 94 and a contact surface 95 that are arranged with the car guide rail 83 therebetween. The inclined surface 94 is inclined with respect to the car guide rail 83 such that the distance between the inclined surface 94 and the car guide rail 83 is gradually diminished upwardly. The contact surface 95 is capable of coming into and out of contact with the car guide rail 83. With the upward displacement of the wedge 84 and the actuator portion 85 with respect to the guide portion 86, the wedge 84 is displaced along the inclined surface 94. Due to this arrangement, the wedge 94 and the contact surface 95 are displaced so as to approach each other, whereby the car guide rail 83 is held between the wedge 84 and the contact surface 95. As a result, the car 2 is braked.

Figure 4:
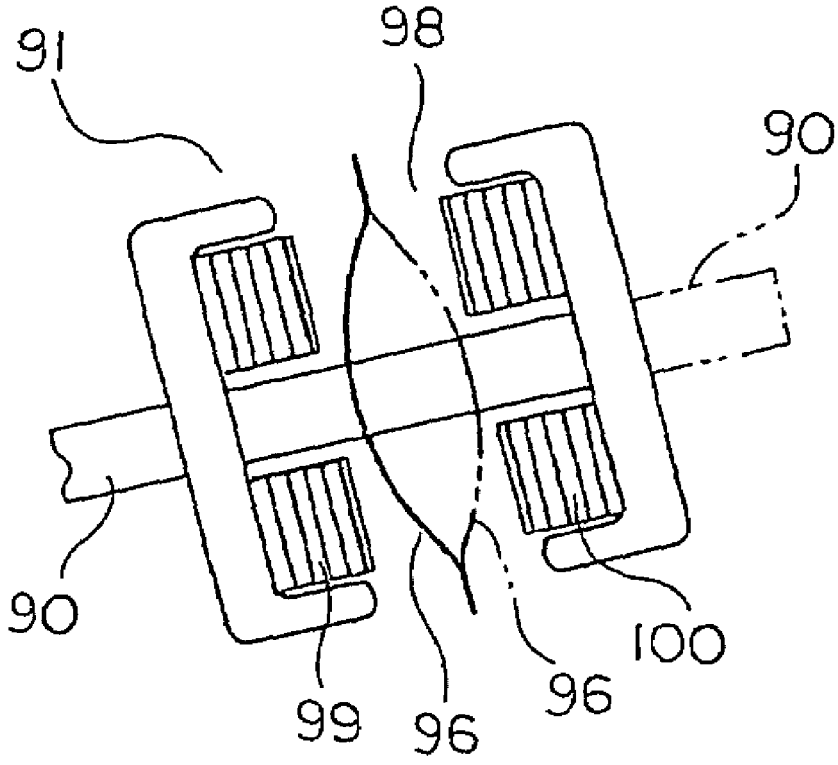
FIG. 4 is a front view of the driving portion of FIG. 2.

FIG. 4 is a front view of the driving portion 91 of FIG. 2. In the drawing, the driving portion 91 has a disc spring 96 which is a biasing portion mounted to the movable portion 90, and an electromagnetic magnet 98 which displaces the movable portion 90 by an electromagnetic force obtained through energization.

The movable portion 90 is fixed to the central portion of the disc spring 96. The disc spring 96 is deformed through reciprocating displacement of the movable portion 90. The biasing direction of the disc spring 96 is switched between the contact position (solid line) and the separation position (chain double-dashed line) of the movable portion 90 through deformation due to the displacement of the movable portion 90. The movable portion 90 is retained at the contact position and the separation position through biasing by the disc spring 96, respectively. That is, the contact state and the separated state of the contact portion 87 with respect to the car guide rail 83 are maintained through the biasing by the disc spring 96.

The electromagnetic magnet 98 has a first electromagnetic portion 99 fixed to the movable portion 90, and a second electromagnetic portion 100 arranged so as to be opposed to the first electromagnetic portion 99. The movable portion 90 is capable of being displaced with respect to the second electromagnetic portion 100. The first electromagnetic portion 99 and the second electromagnetic portion 100 generate electromagnetic force upon input of a braking command signal to the electromagnetic magnet 98, and repel each other. That is, upon input of a braking command signal to the electromagnetic magnet 98, the first electromagnetic portion 99 is displaced away from the second electromagnetic portion 100 together with the movable portion 90. As a result, the contact portion 87 comes into contact with the car guide rail 83, and the wedge 84 is engaged in the gap between the inclined surface 94 and the car guide rail 83, whereby each emergency stop device 20 is operated to brake the car 2.

Figure 5:
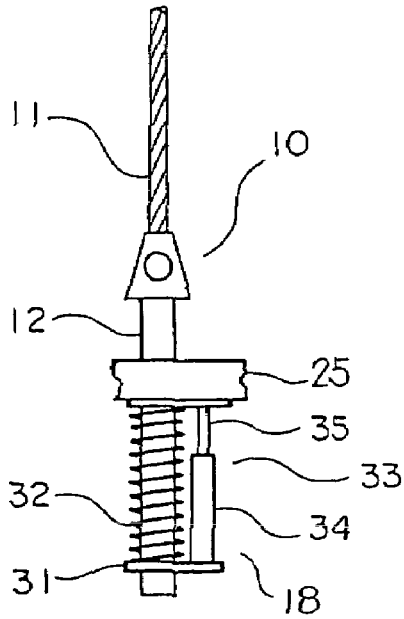
FIG. 5 is a front view of the portion where each first thimble rod of FIG. 1 is connected to the upper frame.
Figure 6:
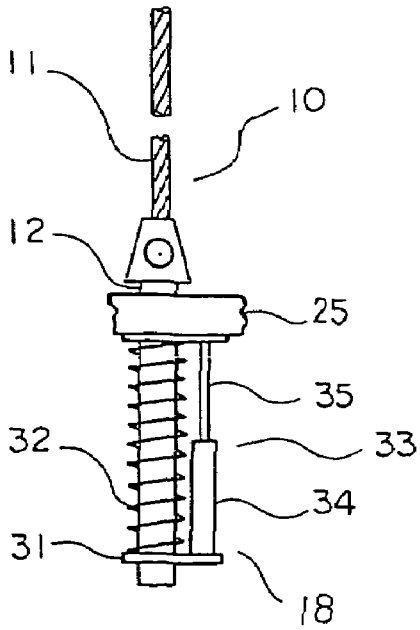
FIG. 6 is a front view showing a state in which one of the main ropes of FIG. 5 has been broken.

FIG. 5 is a front view of the portion where each first thimble rod 12 of FIG. 1 is connected to the upper frame 25. FIG. 6 is a front view showing a state in which one of the main ropes 10 of FIG. 5 has been broken. In the drawings, the thimble rod 12 is a bar-like member slidably extending through the upper frame 25. A fixation plate 31 is fixed to the lower end portion of each thimble rod 12. On the portion of each thimble rod 12 between the upper frame 25 and the fixation plate 31, there is provided a shackle spring 32, which is an elastic member. In the state in which the car 2 is suspended by the main ropes 10, the shackle springs 32 are contracted by the weight of the car 2 (FIG. 5). When the main ropes 10 are broken, the suspending force for the car 2 ceases to exist. As a result, the fixation plates 31 are displaced away from the upper frame 25 by the elastic restoring force of the shackle springs 32. That is, when the main ropes 10 are broken, the thimble rods 12 are displaced downwardly with respect to the upper frame 25.

The rope sensor 18 has a plurality of displacement sensors 33, each provided for each thimble rod 12 between the upper frame 25 and the fixation plate 31. Each displacement sensor 33 has a sensor main body 34 mounted to the fixation plate 31, and a sensor rod 35 which abuts the lower surface of the upper frame 25 and is capable of being vertically displaced with respect to the sensor main body 34. The sensor rod 35 is displaced with respect to the sensor main body 34 through displacement of the fixation plate 31 with respect to the upper frame 25. Each displacement sensor 33 is capable of continuously measuring the displacement amount of the sensor rod 35 with respect to the sensor main body 34. From the sensor main body 34, a measurement signal, which is an electric signal corresponding to the displacement amount of the sensor rod 35, is constantly output to the abnormality control device 19.

Here, it should be noted that the smaller the magnitude of the tension of the main rope 10 becomes, the farther the fixation plate 31 is displaced away from the upper frame 25 by the elastic restoring force of the shackle spring 32, which means that there is a fixed relationship between the magnitude of the tension of the main rope 10 and the displacement amount of the sensor rod 35 with respect to the sensor main body 34. Thus, in the abnormality control device 19, the magnitude of the tension of the main rope 10 is obtained based on the magnitude of the displacement amount measured by the rope sensor 18.

Next, the operation of this embodiment will be described. When all the main ropes 10 are normal, the magnitude of the tension of each main rope 10 is larger than the first abnormality degree setting level, and no braking command signal is output from the abnormality control device 19.

When at least one of the main ropes 10 is elongated, and the magnitude of the tension of the main ropes 10 is reduced to the first abnormality degree setting level, a braking command signal is output from the input/output portion 22 to the operation control device 23. This causes the operation control device 23 to perform control over the power supply to the motor 8, braking the rotation of the drive sheave 7. As a result, the car 2 is settled at the nearest floor in a stable manner.

When the magnitude of the tension of the main ropes 10 is reduced to the second abnormality degree setting level, a braking command signal is output from the input/output portion 22 to the brake device 9. As a result, the brake device 9 is operated, and the rotation of the drive sheave 7 is braked by the brake device 9. This causes the car 2 to make an emergency stop.

When the magnitude of the tension of the main ropes 10 is reduced to the third abnormality degree setting level, a braking command signal is output from the input/output portion 22 to each emergency stop device 20. As a result, each emergency stop device 20 is operated, and the car 2 is braked with respect to the car guide rails. This causes the car 2 to make an emergency stop.

Figure 7:
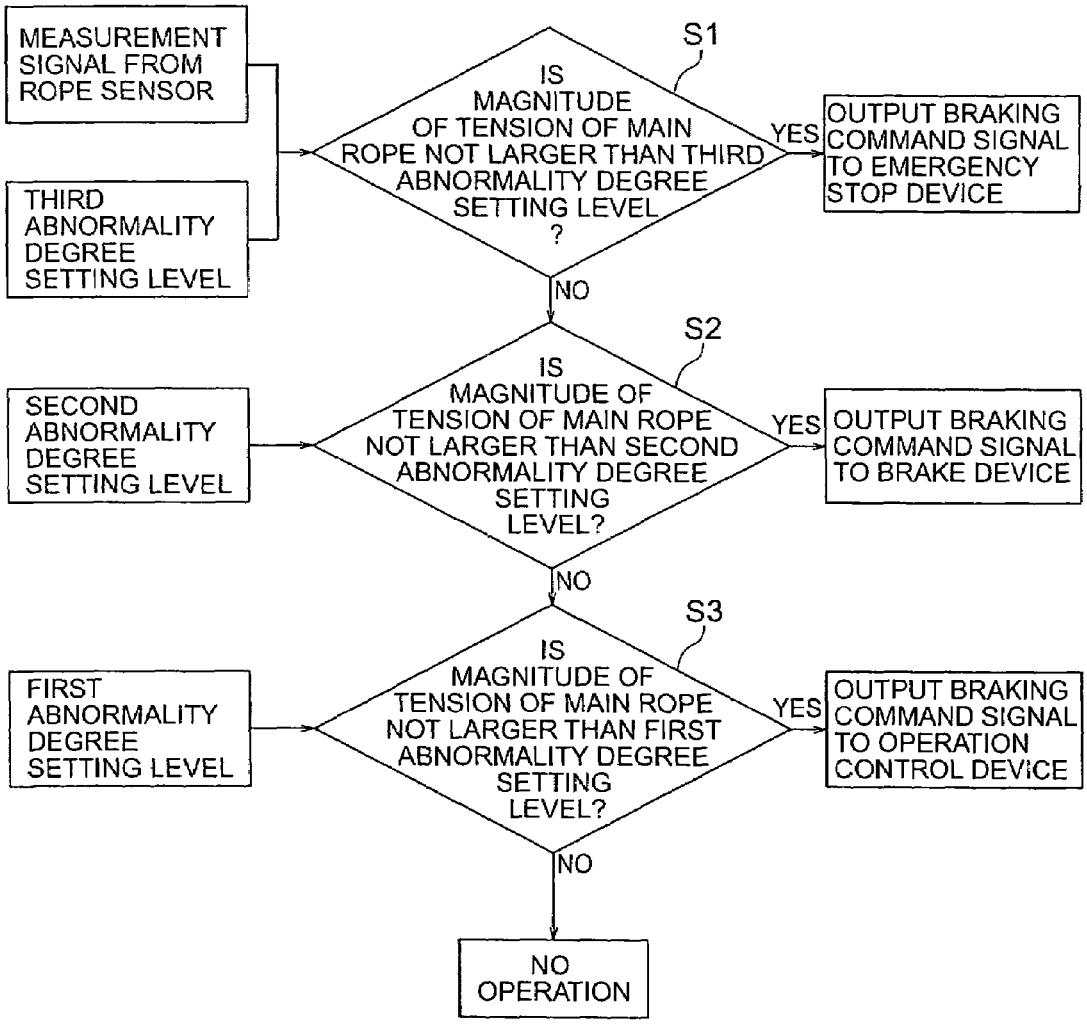
FIG. 7 is a flowchart illustrating the processing operation of the abnormality control device of FIG. 1.

Next, the processing operation of the abnormality control device 19 will be described. FIG. 7 is a flowchart illustrating the processing operation of the abnormality control device 19 of FIG. 1. First, in the processing portion 21, the magnitude of the tension of the main ropes 10 is obtained based on a measurement signal from the rope sensor 18. Thereafter, a judgment is made as to whether the magnitude of the tension of the main ropes 10 is not larger than the third abnormality degree setting level (S1) When the magnitude of the tension of the main ropes 10 is not larger than the third abnormality degree setting level, a braking command signal is output to each emergency stop device 20.

When the magnitude of the tension of the main ropes 10 is larger than the third abnormality degree setting level, a judgment is made as to whether the magnitude of the tension of the main ropes 10 is not larger than the second abnormality degree setting level (S2). When, at this time, the magnitude of the tension of the main ropes 10 is not larger than the second abnormality degree setting level, a braking command signal is output to the brake device 9.

When the magnitude of the tension of the main ropes 10 is larger than the second abnormality degree setting level, a judgment is made as to whether the magnitude of the tension of the main ropes 10 is not larger than the first abnormality degree setting level (S3). When, at this time, the magnitude of the tension of the main ropes 10 is not larger than the first abnormality degree setting level, a braking command signal is output to the operation control device 23. When the magnitude of the tension of the main ropes 10 is not larger than the first abnormality degree setting level, it is determined that the ropes are normal, and no braking command signal is output.

In the elevator apparatus described above, when the magnitude of the tension of the main ropes 10 becomes abnormal, the abnormality control device 19 selectively outputs a braking command signal to one of the operation control device 23, the brake device 9, and the emergency stop devices 20, that is, one of a plurality of braking devices braking the car 2 by methods different from each other according to the magnitude of the tension of the main ropes 10, whereby it is possible to take proper measures according to the abnormality level of the main ropes 10. Due to this arrangement, it is possible to prevent an excessive burden from being imparted to the main ropes 10 or to prevent an excessive impact from being imparted to the car 2. Further, it is possible to operate the braking devices before the speed of the car 2 increases due to abnormality in the main ropes 10, thereby being capable of reducing the braking distance for the car and to reduce the length in the height direction of the hoistway 1. As a result, it is possible to achieve space saving for the elevator apparatus as a whole.

Further, the operation control device 23 performs control over the power supply to the motor 8 upon input of a braking command signal to brake the rotation of the drive sheave 7, thereby being capable of braking the car 2 while controlling the ascent and descent of the car 2. Due to this arrangement, it is possible to allow the car 2 to stop at the nearest floor in a stable manner and to prevent a passenger from being shut up in the car 2.

Further, the brake device 9 is operated upon input of a braking command signal to brake the rotation of the drive sheave 7. As a result, it is possible to make the braking force larger than that for the braking of the drive sheave 7 by the operation control device 23, thereby making it possible to shorten the braking distance for the car 2. When the car 2 is to be stopped as soon as possible although there is little fear of breakage of the main ropes 10, it proves effective to operate the brake device 9.

Further, the emergency stop devices 20 are operated upon input of a braking command signal, and the traveling of the car 2 is braked by pressing the wedge 84 against the car guide rail 83. Therefore, even when the main ropes 10 are broken, it is possible to brake the car 2 more reliably before the speed of the car 2 increases to an abnormal degree.

Further, since the thimble rods 12 are connected to the upper frame 25 through the intermediation of the shackle springs 32, and the amount of displacement between the thimble rods 12 and the upper frame 25 is measured by the displacement sensors 33, it is possible to obtain the magnitude of the tension of the main ropes 10 with a simple construction.

Figure 8:
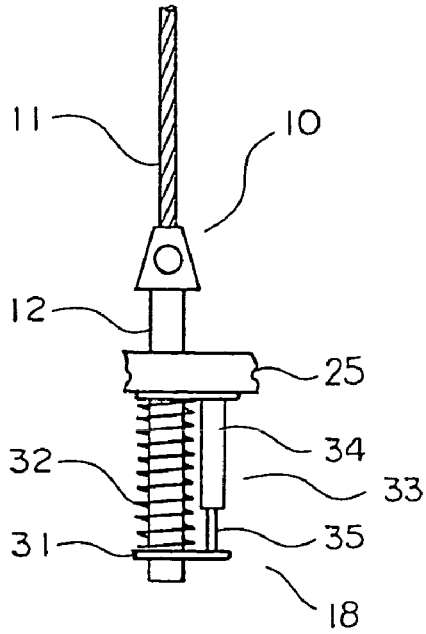
FIG. 8 is a front view of another example of Embodiment 1 of the present invention.
Figure 9:
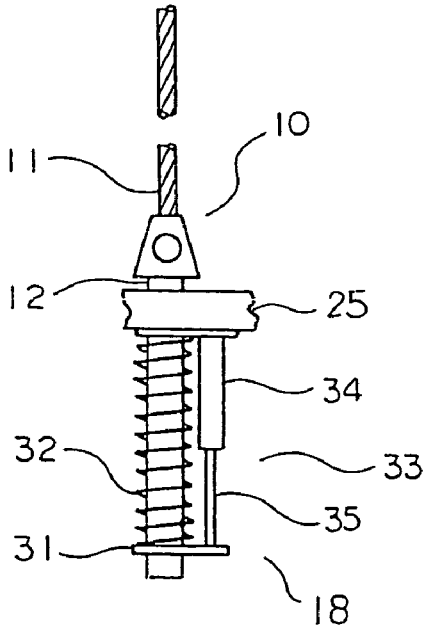
FIG. 9 is a front view showing a state in which the main rope of FIG. 8 has been broken.

While in the above example the displacement sensors 33 are arranged such that the sensor rods 35 abut the lower surface of the upper frame 25, it is also possible, as shown in FIGS. 8 and 9, to reverse the direction of the displacement sensors 33 and arrange the displacement sensors 33 such that the sensor rods 35 abut the upper surfaces of the fixation plates 31.

Figure 10:
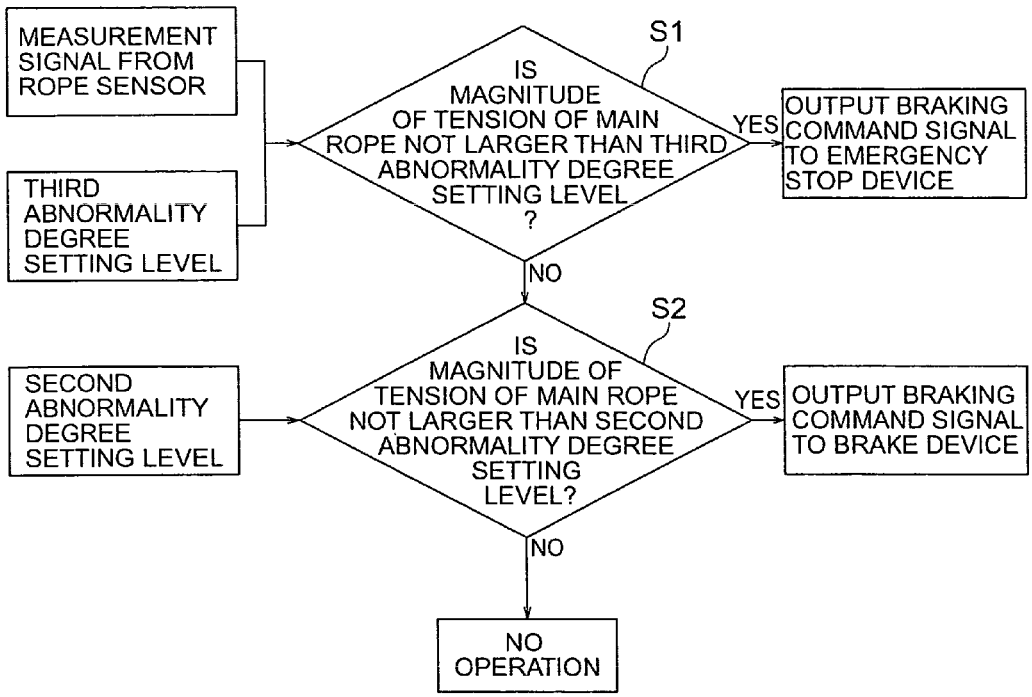
FIG. 10 is a flowchart showing another example of the processing operation of the abnormality control device of Embodiment 1 of the present invention.

Further, while in the above example the abnormality control device 19 judges the degree of abnormality in the main ropes 10 in three stages, i.e., in the first through third abnormality degree setting levels, it is also possible, as shown in FIG. 10, to judge the degree of abnormality in the main ropes 10 in two stages, i.e., in the second and third abnormality degree setting levels. In this case, the braking command signal is output to the emergency stop devices 20 when the degree of abnormality is not larger than the third abnormality degree setting level, and to the brake device 9 when the degree of abnormality is not larger than the second abnormality degree setting level.

Further, while in the above example the abnormality control device 19 judges the degree of abnormality in the main ropes 10 by the magnitude of the tension of the main ropes 10, it is also possible to judge the degree of abnormality in the plurality of main ropes 10 by the number of main ropes 10 that have been broken. In this case, the braking command signal is selectively output from the abnormality control device 19 to one of the operation control device 23, the brake device 9, and the emergency stop devices 20 according to the number of main ropes 10 that have been broken. Here, setting is made in the abnormality control device 19 such that the larger the number of main ropes 10 that have been broken becomes, the larger the degree of abnormality becomes.

Embodiment 2

Figure 11:
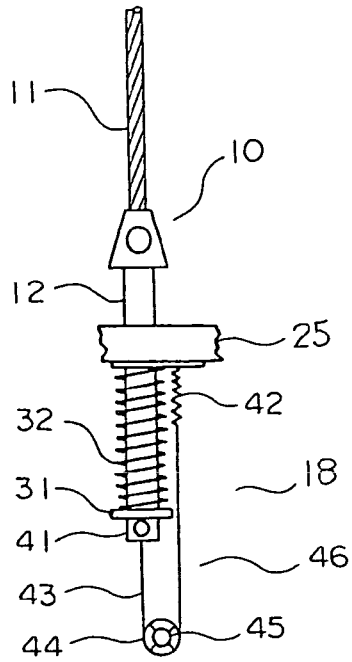
FIG. 11 is a front view of the rope sensor of an elevator apparatus according to Embodiment 2 of the present invention.
Figure 12:
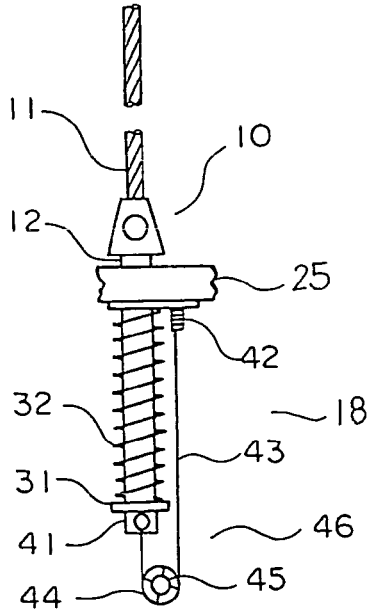
FIG. 12 is a front view showing a state in which the main rope of FIG. 11 has been broken.

FIG. 11 is a front view of the rope sensor 18 of an elevator apparatus according to Embodiment 2 of the present invention. FIG. 12 is a front view showing a state in which the main rope 10 of FIG. 11 has been broken. In the drawings, the rope sensor 18 has, for the respective thimble rods 12, a plurality of displacement sensors 46 for measuring the amount of displacement of the thimble rods 12 with respect to the upper frame 25. Further, at the lower end of each thimble rod 12, there is provided a wire connecting portion 41.

Each displacement sensor 46 has a displacement measuring pulley 44 arranged below the thimble rod 12, a wire 43 displaced with the thimble rod 12 and wrapped around the displacement measuring pulley 44, a bias spring 42 which is an elastic member for biasing the wire 43 so as to pull the same, and a rotary encoder 45 which is a rotation angle measuring portion for measuring the rotation angle of the displacement measuring pulley 44. Apart from the rotary encoder, examples of the rotation angle measuring portion include a rotary switch and an inclination angle sensor.

The displacement measuring pulley 44 is provided on a mounting member (not shown) fixed to the upper frame 25. The bias spring 42 is connected to the lower surface of the upper frame 25. One end of the wire 43 is connected to the bias spring 42, and the other end of the wire 43 is connected to the wire connecting portion 41. The bias spring 42 is pulled and expanded by the wire 43. Tension is imparted to the wire 43 by the elastic restoring force of the bias spring 42.

In the normal state in which the car 2 is suspended by the main ropes 10, the shackle springs 32 are contracted between the upper frame 25 and the fixation plates 31 by the weight of the car 2. As the magnitude of the tension of the main ropes 10 is reduced, the thimble rods 12 are displaced downwardly with respect to the upper frame 25 by the elastic restoring force of the shackle springs 32. With the displacement of the thimble rods 12 with respect to the upper frame 25, the wires 43 are displaced, and the pulleys 44 are rotated. That is, the amount of displacement of the thimble rods 12 with respect to the upper frame 25 is measured by being converted to the rotation angle of the displacement measuring pulleys 44.

The rotary encoders 45 are provided on the displacement measuring pulleys 44. Further, each rotary encoder 45 constantly measures the rotation angle of the pulley 44 and outputs a measurement signal to the abnormality control device 19. In the abnormality control device 19, the rotation angle is obtained based on the measurement signal from each rotary encoder 45, and the magnitude of the tension of each main rope 10 is obtained. Otherwise, this embodiment is of the same construction and operation as Embodiment 1.

Also in the elevator apparatus described above, the amount of displacement of each thimble rod 12 with respect to the upper frame 25 is measured by the displacement sensor 46. Therefore, as in Embodiment 1, it is possible to obtain the magnitude of the tension of each main rope 10 with a simple construction.

Embodiment 3

Figure 13:
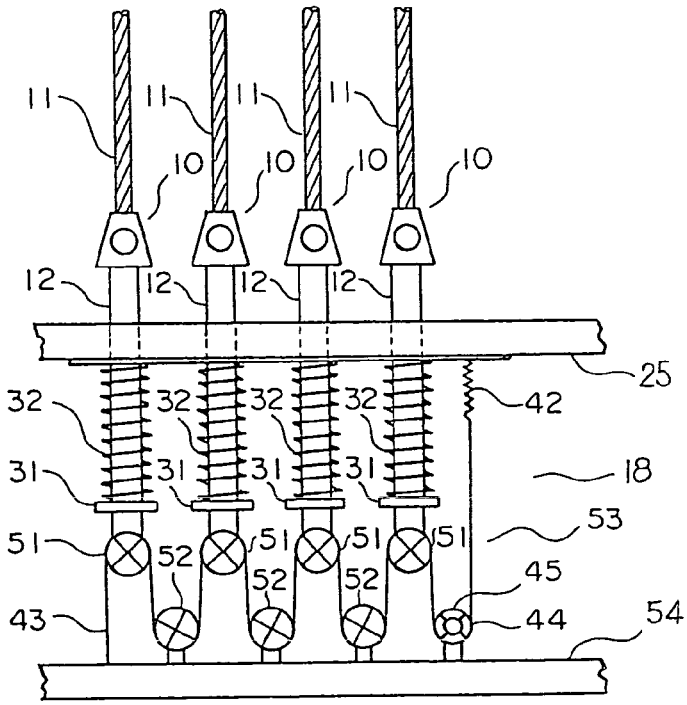
FIG. 13 is a front view of the rope sensor according to Embodiment 3 of the present invention.
Figure 14:
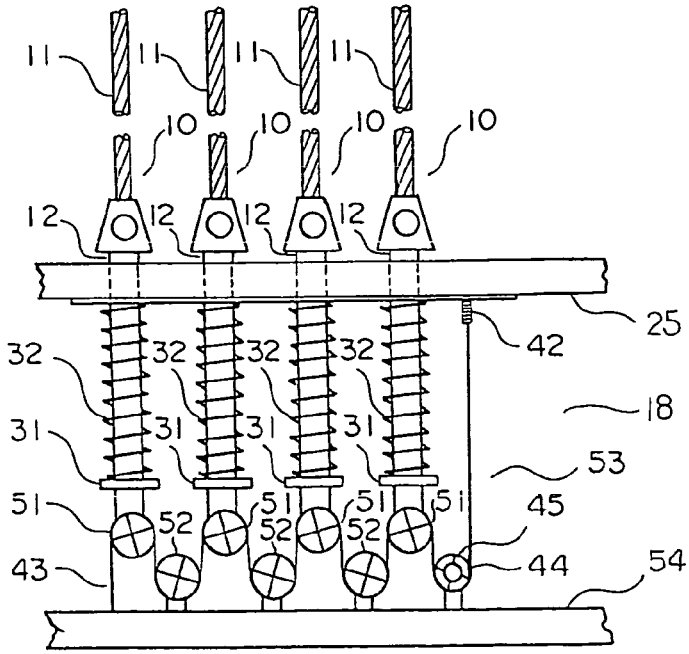
FIG. 14 is a front view showing a state in which all the main ropes of FIG. 13 have been broken.

FIG. 13 is a front view of the rope sensor 18 according to Embodiment 3 of the present invention. FIG. 14 is a front view showing a state in which all the main ropes 10 of FIG. 13 have been broken. In the drawings, the rope sensor 18 has a displacement sensor 53 for measuring the average amount of displacement of all the thimble rods 12 with respect to the upper frame 25. Further, at the upper frame 25, there is provided a horizontal mounting member 54 below each thimble rod 12.

The displacement sensor 53 has a displacement measuring pulley 44 arranged on the mounting member 54, a wire 43 displaced due to the displacement of each thimble rod 12 and wrapped around the displacement measuring pulley 44, a bias spring 42 for biasing the wire 43 so as to pull the same, and a rotary encoder 45 for measuring the rotation angle of the displacement measuring pulley 44.

At the lower ends of the thimble rods 12, there are provided a plurality of movable pulleys 51. A plurality of stationary pulleys 52 are provided on the mounting member 54. The bias springs 42 are connected to the lower surface of the upper frame 25. Further, the bias spring 42 is arranged above the displacement measuring pulley 44.

One end of the wire 43 is connected to the mounting member 54, and the other end of the wire 43 is connected to the bias spring 42. Further, the wire 43 is, starting with one end thereof, wrapped successively around the movable pulleys 51 and the stationary pulleys 52, and is then wrapped around the displacement measuring pulley 44 before reaching the other end thereof. Tension is imparted to the wire 43 by the elastic restoring force of the bias spring 42.

The processing portion 21 stores a rope abnormality degree judgment criterion for judging abnormality in each main rope 10. As the rope abnormality degree judgment criterion, there is set an abnormality degree setting level which is of a smaller value than the magnitude of the tension of each main rope 10 during normal operation. The magnitude of the tension of each main rope 10 is reduced when the main rope 10 is broken, so the abnormality degree setting level is set so as to be smaller than the magnitude of the tension of the main ropes 10 when all the main ropes 10 have been broken.

Further, the processing portion 21 obtains the magnitude of the tension of the main ropes 10 based on information from a displacement sensor 53. The processing portion 21 compares the magnitude of the tension obtained based on information from the rope sensor 18 with the rope abnormality degree judgment criterion, thereby making a judgment as to whether there is any abnormality in the main ropes 10. When there is abnormality in the main ropes 10, the abnormality control device 19 outputs a braking command signal to the emergency stop devices 20. Otherwise, this embodiment of the same construction as Embodiment 2.

Next, the operation of the displacement sensor 53 will be described. In the normal state in which the car 2 is suspended by the main ropes 10, all the shackle springs 32 are contracted between the upper frame 25 and the fixation plates 31 due to the weight of the car 2. In this state, an averaged downward pull-down force is imparted to all the thimble rods 12 by the wire 43.

When all the main ropes 10 are broken, all the thimble rods 12 are displaced downwardly with respect to the upper frame 25 by the elastic restoring force of the shackle springs 32, and the wire 43 is displaced. As a result, the displacement measuring pulley 44 is rotated, and a measurement signal according to the rotation angle thereof is output to the abnormality control device 19.

Figure 15:
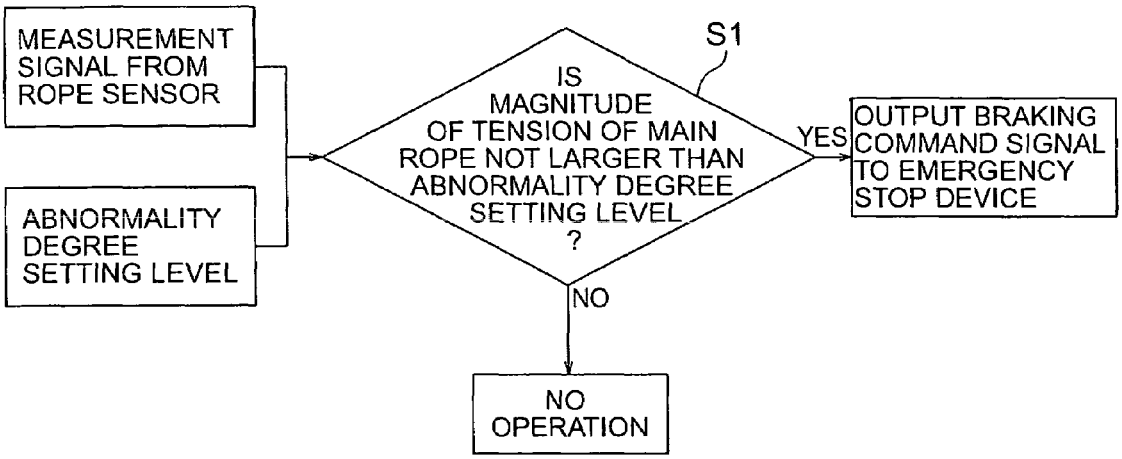
FIG. 15 is a flowchart illustrating the processing operation of the abnormality control device of the elevator apparatus according to Embodiment 3.

Next, the processing operation of the abnormality control device 19 will be described. FIG. 15 is a flowchart illustrating the processing operation of the abnormality control device 19 of the elevator apparatus according to Embodiment 3. First, the magnitude of the tension of the main ropes 10 is obtained based on the measurement signal from the displacement sensor 53, and then a judgment is made as to whether the magnitude of the tension of the main ropes 10 is smaller than the abnormality degree setting level or not (S1) When the magnitude of the tension of the main ropes 10 is not larger than the abnormality degree setting level, a braking command signal is output to each emergency stop device 20. The emergency stop devices 20 are operated upon input of the braking command signal. As a result, the car 2 is braked. When the magnitude of the tension of the main ropes 10 is larger than the abnormality degree setting level, no braking command signal is output.

In the elevator apparatus described above, the displacement sensor 53 has the wire 43 operationally linked with a plurality of thimble rods 12. As a result, it is only necessary to provide one displacement sensor 53 for the plurality of thimble rods 12, thus making it possible to reduce the number of parts of the displacement sensor 53 and to achieve a reduction in cost.

Embodiment 4

Figure 16:
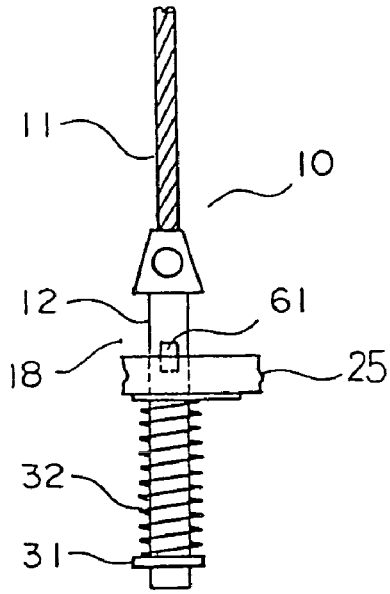
FIG. 16 is a front view of the rope sensor of an elevator apparatus according to Embodiment 4 of the present invention.
Figure 17:
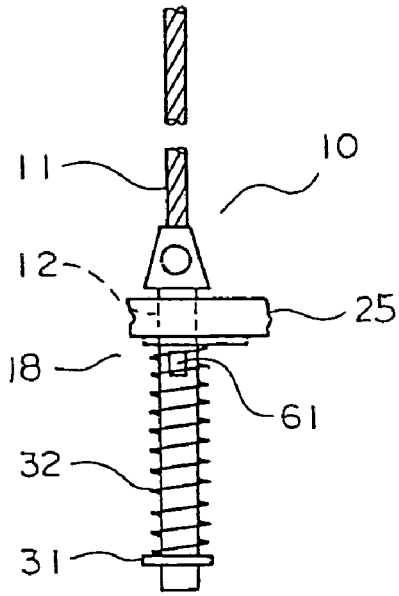
FIG. 17 is a front view showing a state in which the main rope of FIG. 16 has been broken.

FIG. 16 is a front view of the rope sensor 18 of an elevator apparatus according to Embodiment 4 of the present invention. Further, FIG. 17 is a front view showing a state in which the main rope 10 of FIG. 16 has been broken. In the drawings, the rope sensor 18 has a plurality of strain gauges 61 for measuring the expansion/contraction amount of the thimble rods 12. Each strain gauge 61 is affixed to each thimble rod 12.

The abnormality control device 19 obtains the expansion/contraction amount of each thimble rod 12 based on information from each strain gauge 61, and obtains the magnitude of the tension of each main rope 10 from the expansion/contraction amount thus obtained. That is, by utilizing the fact that the thimble rod 12 expands or contracts according to the magnitude of the tension of the main rope 10, the abnormality control device 19 obtains the magnitude of the tension of the main rope 10. Otherwise, this embodiment is of the same construction as Embodiment 1.

Next, the operation of this embodiment will be described. In the normal state, each thimble rod 12 is pulled by the weight of the car 2, and is expanded if to a minute degree. In this state, the magnitude of the tension of the main rope 10 obtained by the abnormality control device 19 is larger than the first abnormality degree setting level.

As the magnitude of the tension of the main rope 10 is reduced, the tension of the thimble rod 12 is also reduced, and the thimble rod 12 starts to contract. According to the magnitude of the tension of the main rope 10 obtained from information from the strain gauge 61, the abnormality control device 19 selectively outputs a braking command signal to the operation control device 23, the brake device 9, and the emergency stop devices 20. From this onward, the operation of this embodiment is the same as that of Embodiment 1.

In the elevator apparatus described above, the expansion/contraction amount of each thimble rod 12 is measured by the strain gauge 61, thereby being capable of detecting the magnitude of the tension of each main rope 10. As a result, solely by affixing the strain gauge 61 to each thimble rod 12, it is possible to obtain the magnitude of the tension of each main rope 10. Accordingly, it is possible to further reduce the number of parts of the rope sensor 18. As a result, it is possible to further reduce the cost of the rope sensor 18.

Embodiment 5

Figure 18:
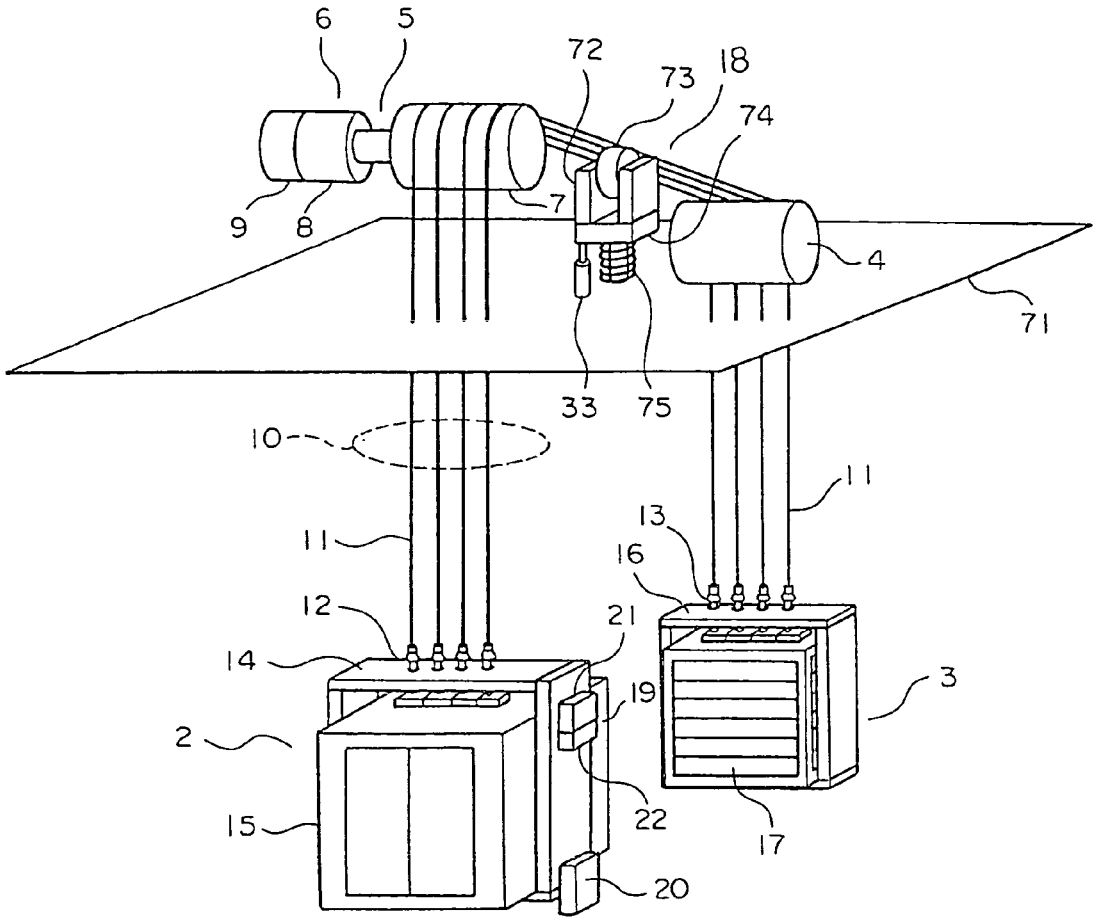
FIG. 18 is a perspective view of an elevator apparatus according to Embodiment 5 of the present invention.
Figure 19:
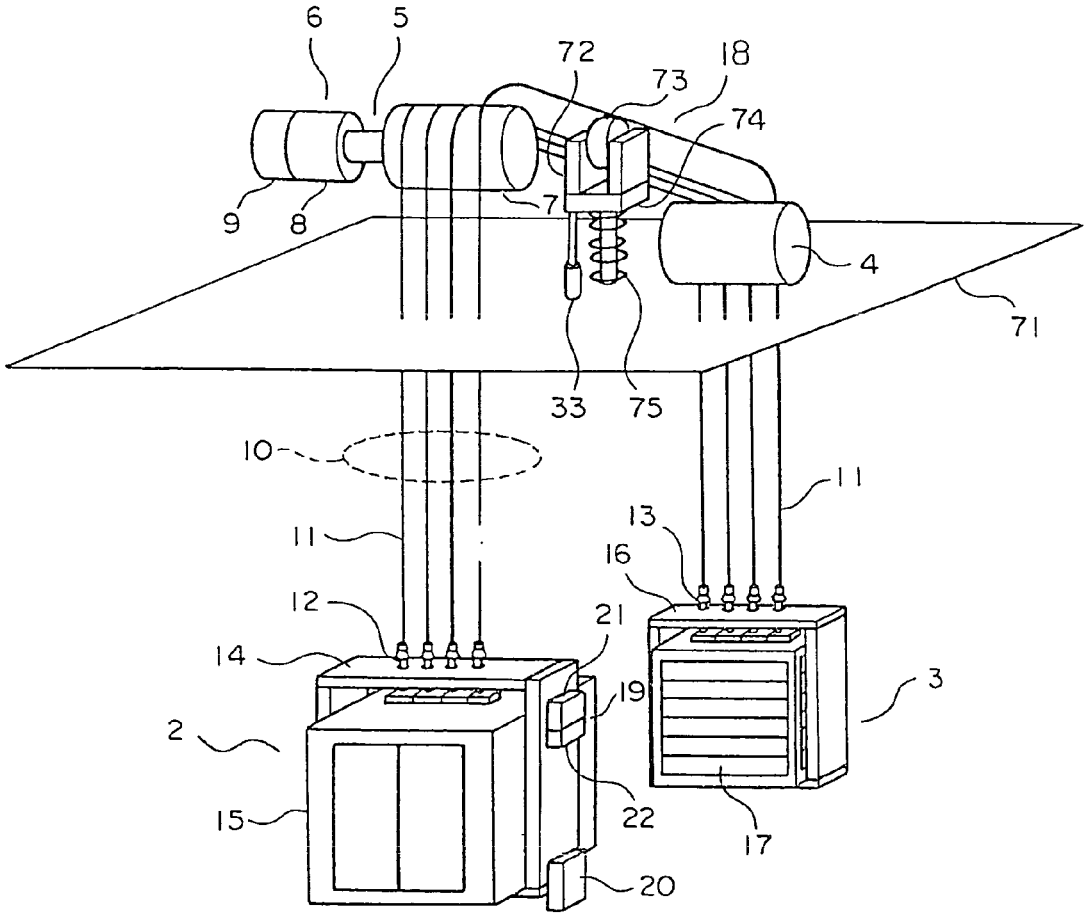
FIG. 19 is a perspective view showing a state in which one of the main ropes of FIG. 18 has been broken.

FIG. 18 is a perspective view of an elevator apparatus according to Embodiment 5 of the present invention. FIG. 19 is a perspective view showing a state in which one of the main ropes 10 of FIG. 18 has been broken. In the drawings, a support member 71 is secured in position in the hoistway 1. A displacement member 72, which is capable of being displaced vertically with respect to the support member 71, is supported by the support member 71 through the intermediation of a support spring 75 which is an elastic member. The displacement member 72 has a displacement member main body 74 placed on the support spring 75, and an abutment pulley 73 which is rotatably provided in the displacement member main body 74 and which is a contact portion capable of coming into and out of contact with the portions of the main ropes 10 between the drive sheave 7 and the deflection wheel 4.

In the normal state, the support spring 75 is contracted between the displacement member 72 and the support member 71. The abutment pulley 73 is pressed against the main ropes 10 by the elastic restoring force of the support spring 75. In this example, the abutment pulley 73 is pressed against only one of a plurality of main ropes 10.

Between the displacement member main body 74 and the support member 71, there is provided a displacement sensor 33 of a construction similar to that of Embodiment 1. The displacement sensor 33 measures the displacement amount of the displacement member 72 with respect to the support member 71. Further, the displacement sensor 33 constantly outputs a measurement signal corresponding to the displacement amount of the displacement member 72 to the abnormality control device 19. The abnormality control device 19 obtains the magnitude of the tension of the main ropes 10 based on the information from the displacement sensor 33. The rope sensor 18 has the displacement sensor 33, the displacement member 72, and the support spring 75. Otherwise, this embodiment is of the same construction as Embodiment 1.

Next, the operation of this embodiment will be described. When the magnitude of the tension of the main ropes 10 is normal, the displacement member 72 is pushed toward the support member 71 by the main ropes 10, and the support spring 75 is contracted. In this state, the displacement amount of the support member 72 with respect to the support member 71 is small, and no braking command signal is output from the abnormality control device 19.

When the magnitude of the tension of the main ropes 10 is reduced, the tension of the thimble rods 12 is also reduced, and the displacement member 72 is displaced away from the support member 71 by the elastic restoring force of the support spring 75. As a result, the displacement amount measured by the displacement sensor 33 increases. The abnormality control device 19 obtains the magnitude of the tension of the main ropes 10 from the displacement amount measured by the displacement sensor 33, and selectively outputs a braking command signal to the operation control device 23, the brake device 9, and the emergency stop devices 20 according to the magnitude of the tension thus obtained. From this onward, the operation of this embodiment is the same as that of Embodiment 1.

Also in this elevator apparatus described above, it is possible to measure the magnitude of the tension of the main ropes 10. Further, since the rope sensor 18 is provided on the support member 71 secured in position in the hoistway 1, access to the rope sensor 18 by the operator can be facilitated, thus facilitating the maintenance operation.

Embodiment 6

Figure 20:
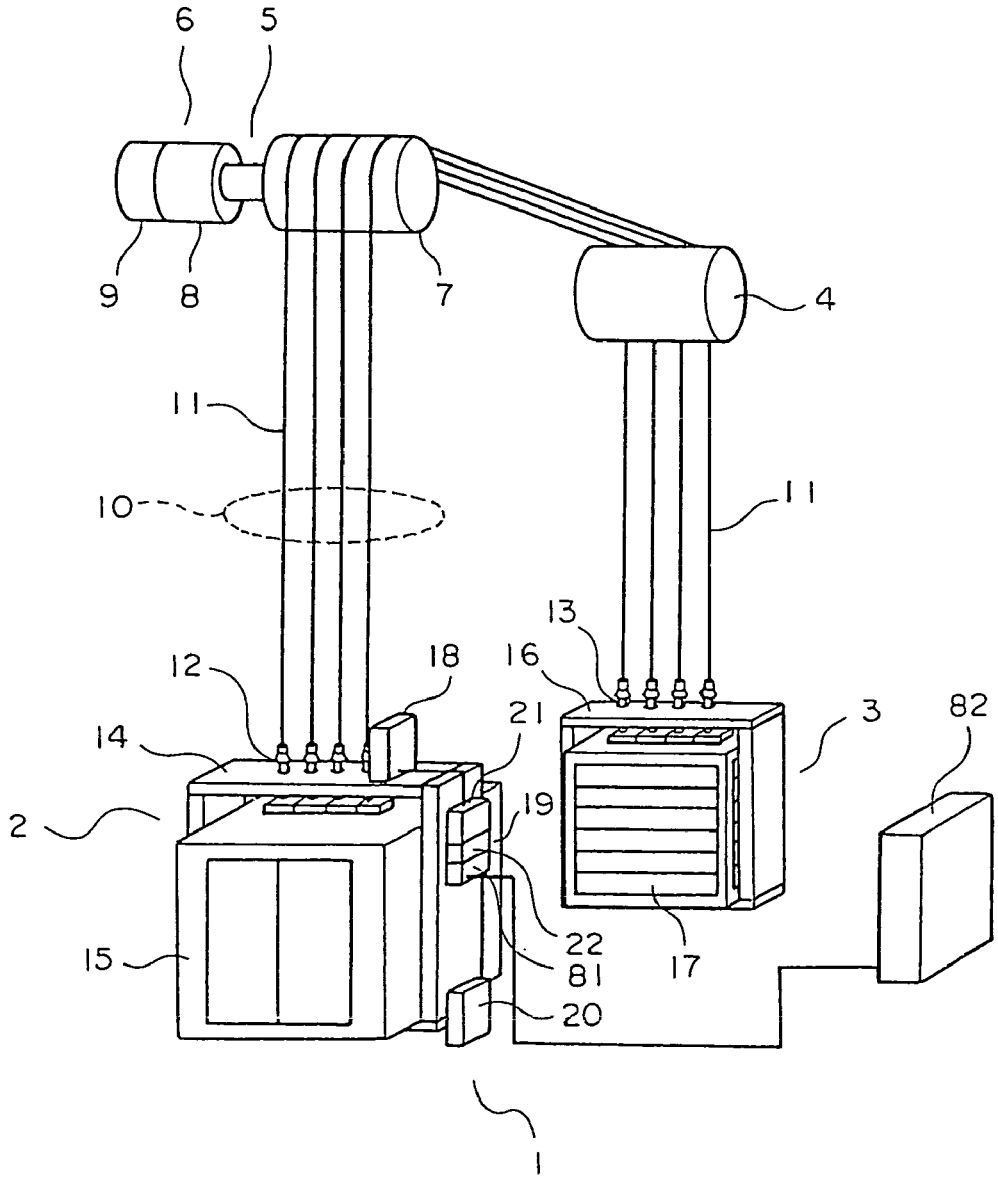
FIG. 20 is a perspective view of an elevator apparatus according to Embodiment 6 of this embodiment.

FIG. 20 is a perspective view of an elevator apparatus according to Embodiment 6 of this embodiment. In the drawing, a display input/output portion 81 is provided on the abnormality control device 19. Electrically connected to the display input/output portion 81 is a display device 82 which is an alarm device for issuing an alarm indicating any abnormality in the elevator apparatus. The display device 82 is installed in the superintendent's room.

The processing portion 21 further stores a maintenance setting level for a degree of abnormality in the main ropes 10 which is smaller than the first through third abnormality degree setting levels. The maintenance setting level is set to a value smaller than the magnitude of the tension of the main ropes 10 in the normal state and larger than the value of the third abnormality degree setting level.

The abnormality control device 19 outputs an abnormality signal from the display input/output portion 81 to the display device 82 when the magnitude of the tension of the main ropes 10 obtained based on the information from the rope sensor 18 is not larger than the maintenance setting level and larger than the first abnormality degree setting level. That is, the abnormality control device 19 outputs an abnormality signal to the display device 82 at a stage where the magnitude of the tension of the main ropes 10 is larger than the magnitude of the tension of the main ropes 10 when a braking command signal is output.

The display device 82 constantly gives a display as to whether there is any abnormality in the main ropes 10. Upon input of an abnormality signal, the display device 82 gives a display specifying the main rope 10 that has become abnormal and a display to the effect that the specified main rope 10 needs maintenance, thus giving an alarm. Otherwise, this embodiment is of the same construction as Embodiment 1.

Next, the operation of this embodiment will be described. When at least one of the main ropes 10 has been elongated, and the magnitude of the tension of the main ropes 10 has been reduced to the maintenance setting level, an abnormality signal is output from the maintenance input/output portion 81 to the display device 82. As a result, the display device 82 displays the abnormality in the main ropes 10, thus giving an alarm.

The respective operations when the magnitude of the tension of the main ropes 10 is reduced to the first through third abnormality degree setting levels are the same as those in Embodiment 1.

Figure 21:
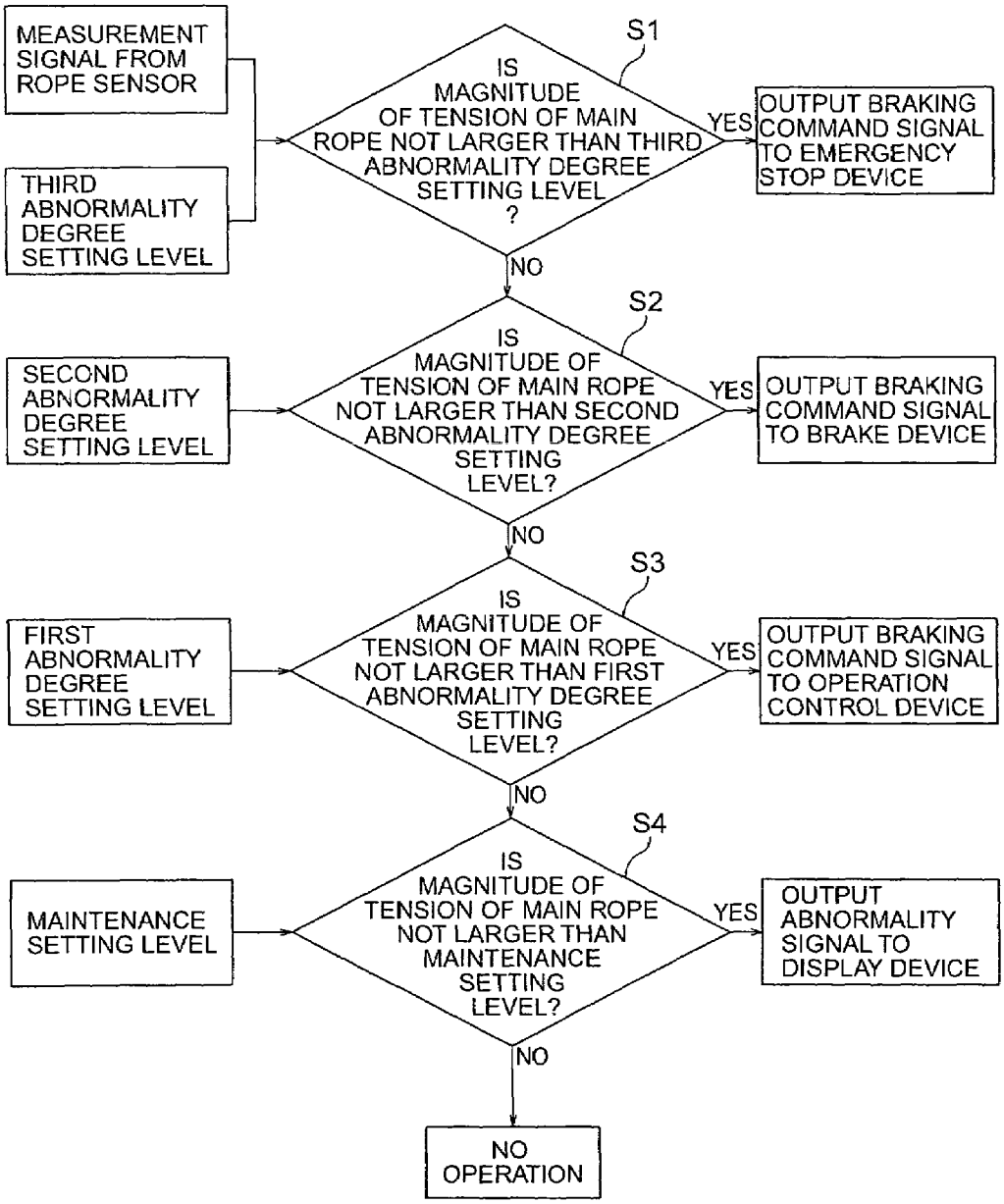
FIG. 21 is a flowchart illustrating the processing operation of the abnormality control device of FIG. 20.

Next, the processing operation of the abnormality control device 19 will be described. FIG. 21 is a flowchart illustrating the processing operation of the abnormality control device 19 of FIG. 20. In the processing portion 21, the magnitude of the tension of the main ropes 10 is obtained based on the measurement signal from the rope sensor 18, and then a judgment is made as to whether the magnitude of the tension of the main ropes 10 is not larger than the third abnormality degree setting level (S1). When the magnitude of the tension of the main ropes 10 is not larger than the third abnormality degree setting level, a braking command signal is output to each emergency stop device 20.

When the magnitude of the tension of the main ropes 10 is larger than the third abnormality degree setting level, a judgment is made as to whether the magnitude of the tension of the main ropes 10 is not larger than the second abnormality degree setting level (S2). At this time, when the magnitude of the tension of the main ropes 10 is not larger than the second abnormality degree setting level, a braking command signal is output to the brake device 9.

When the magnitude of the tension of the main ropes 10 is larger than the second abnormality degree setting level, a judgment is made as to whether the magnitude of the tension of the main ropes 10 is not larger than the first abnormality degree setting level (S3). At this time, when the magnitude of the tension of the main ropes 10 is not larger than the first abnormality degree setting level, a braking command signal is output to the operation control device 23.

When the magnitude of the tension of the main ropes 10 is larger than the first abnormality degree setting level, a judgment is made as to whether the magnitude of the tension of the main ropes 10 is not larger than the maintenance setting level (S4). At this time, when the magnitude of the tension of the main ropes 10 is not larger than the maintenance setting level, an abnormality signal is output to the display device 82. When the magnitude of the tension of the main ropes 10 is not larger than the maintenance setting level, the main ropes 10 are regarded as normal.

In the elevator apparatus described above, the abnormality control device 19 outputs an abnormality signal at a stage where the degree of abnormality in the main ropes 10 is relatively small, and the display device 82 gives an alarm upon input of the abnormality signal. As a result, any abnormality in the main ropes 10 is found out at an early stage for maintenance operation, thus making it possible to prevent breakage of the main ropes 10 more reliably.

While in the above example an alarm indicating any abnormality in the main ropes 10 is given through display on the display device 82, it is also possible to give a warning sound together with the display on the display device 82. This arrangement makes it possible to more reliably recognize the alarm given by the display device 82.

The invention claimed is:

1. An elevator apparatus comprising:

a detecting portion which detects a magnitude of tension of a main rope suspending a car;

a plurality of braking devices which brake ascent or descent of the car by methods that are different from each other; and an abnormality control device which is capable of ascertaining the magnitude of the tension based on information from the detecting portion and which, when the magnitude of the tension becomes abnormal, selects a first one of the braking devices when the magnitude of the tension is less than a first tension magnitude threshold and selects a second one of the braking devices when the magnitude of the tension is less than a second tension magnitude threshold, and outputs a braking command signal to the selected one of the braking devices.

2. An elevator apparatus according to claim 1, further comprising an alarm device which gives an alarm to the effect that the magnitude of the tension has become abnormal, wherein, when the magnitude of the tension becomes abnormal, the abnormality control device outputs an abnormality signal to the alarm device at a stage where the magnitude of the tension is larger than the magnitude of the tension when the braking command signal is output, and wherein the alarm device is adapted to give the alarm upon input of the abnormality signal.

3. An elevator apparatus according to claim 1, further comprising a driving device which has a drive sheave around which the main rope is wrapped and a motor for rotating the drive sheave and which causes the car to be raised and lowered through rotation of the drive sheave, wherein at least one of the braking devices is an operation control device which performs control over power supply to the motor to thereby brake the rotation of the drive sheave.

4. An elevator apparatus according to claim 1, further comprising a driving device which has a drive sheave around which the main rope is wrapped and a motor for rotating the drive sheave and which causes the car to be raised and lowered through rotation of the drive sheave, wherein at least one of the braking devices is a brake device which has a braking member and which brakes the rotation of the drive sheave through contact of the braking member with the drive sheave.

5. An elevator apparatus according to claim 1, wherein at least one of the braking devices is an emergency stop device which is mounted on the car, which has a braking member, and which brakes the car through contact of the braking member with a guide rail guiding the car.

6. An elevator apparatus according to claim 1, wherein the main rope is provided with a connecting portion connected to the car through the intermediation of an elastic member, and wherein the detecting portion detects the magnitude of the tension by measuring a displacement amount of the connecting portion with respect to the car.

7. An elevator apparatus according to claim 1, wherein the main rope is provided with a connecting portion connected to the car, and wherein the detecting portion detects the magnitude of the tension by measuring an expansion or contraction amount of the connecting portion.

8. A method of operating an elevator apparatus, the method comprising:

detecting a magnitude of tension of a main rope suspending a car;

selecting a first one of a plurality of braking devices when the magnitude of the tension in the detecting becomes abnormal and the magnitude of the tension in the detecting is less than a first tension magnitude threshold, the first braking device arranged to brake ascent or descent of the car by a first braking method;

selecting a second one of the plurality of braking devices when the magnitude of the tension in the detecting becomes abnormal and the magnitude of the tension in the detecting is less than a second tension magnitude threshold, the second braking device arranged to brake ascent or descent of the car by a second braking method different than the first braking method; and outputting a braking command signal to the selected one of the braking devices.

* * * * *